United States Patent [19]

Singer et al.

[11] Patent Number: 4,966,725

[45] Date of Patent: Oct. 30, 1990

[54] AQUEOUS DISPERSIONS FOR SIMULTANEOUSLY PROVIDING FIBROUS MATERIALS WITH A SOFTENING AND HYDROPHILIC FINISH, A PROCESS FOR THEIR PRODUCTION AND THEIR USE

[75] Inventors: Heinrich Singer, Horgau; Werner Stechele, Diedorf; Michael Bernhein, Aystetten, all of Fed. Rep. of Germany

[73] Assignee: Ciba-Geigy Corporation, Ardsley, N.Y.

[21] Appl. No.: 302,691

[22] PCT Filed: Jul. 18, 1987

[86] PCT No.: PCT/EP87/00391

§ 371 Date: Jan. 19, 1989

§ 102(e) Date: Jan. 19, 1989

[87] PCT Pub. No.: WO88/00991

PCT Pub. Date: Feb. 11, 1988

[30] Foreign Application Priority Data

Aug. 1, 1986 [DE] Fed. Rep. of Germany ..... 3626051

[51] Int. Cl.[5] ..... D06M 13/46; D06M 15/26; C08F 2/18; C08L 33/08

[52] U.S. Cl. ..... 252/8.8; 8/115.65; 8/115.66; 252/8.9

[58] Field of Search ..... 252/8.8, 8.9

[56] References Cited

U.S. PATENT DOCUMENTS

| | | | |
|---|---|---|---|
| 4,155,855 | 5/1979 | Goffinet et al. | 252/8.8 |
| 4,179,382 | 12/1979 | Rudkin et al. | 252/8.8 |
| 4,239,671 | 12/1980 | Fink et al. | 524/555 |
| 4,293,600 | 10/1981 | Fink et al. | 427/385.5 |
| 4,326,965 | 4/1982 | Lips et al. | 252/8.8 |
| 4,631,208 | 12/1986 | Westall | 427/387 |

FOREIGN PATENT DOCUMENTS

| | | |
|---|---|---|
| 52-081197 | 7/1977 | Japan . |
| 52-132194 | 11/1977 | Japan . |
| 1549180 | 7/1979 | United Kingdom . |
| 2166750 | 5/1986 | United Kingdom . |

OTHER PUBLICATIONS

Chem. Abstr., 88(2): 8447p. (Jan. 9, 1989).

*Primary Examiner*—A. Lionel Clingman
*Attorney, Agent, or Firm*—Edward McC. Roberts; Kevin T. Mansfield

[57] ABSTRACT

The present invention describes aqueous dispersions for simultaneously providing fibrous materials with a softening and hydrophilic finish containing (1) at least one quaternary compound with at least one long-chain alkyl residue,
(2) a polymer or copolymer on the basis of alkylacrylates with alkyl residues having at least 4 C atoms,
(3) optionally in addition an emulsifier which is other than (1) and
(4) optionally a silicone which provides a hydrophilic finish.

Furthermore, a process for the production of said aqueous dispersion is claimed.

Using said dispersions, fibrous materials, especially cotton towelling fabrics, are provided with a particularly soft, velvety feel and very good to outstanding hydrophily.

15 Claims, No Drawings

AQUEOUS DISPERSIONS FOR SIMULTANEOUSLY PROVIDING FIBROUS MATERIALS WITH A SOFTENING AND HYDROPHILIC FINISH, A PROCESS FOR THEIR PRODUCTION AND THEIR USE

The present invention describes aqueous dispersions for simultaneously providing fibrous materials with a softening and hydrophilic finish which contain at least one quaternary compound with at least one long-chain alkyl residue and a polymer or copolymer on the basis of alkylacrylates with alkyl residues having at least 4 C atoms, a process for their production and their use.

The use of copolymers on the basis of alkylacrylates for finishing textiles is long known (DE-AS No. 1 119 609 and DE-PS No. 1 209 989). The feel of the fibrous materials treated therewith is favourably affected. It is also possible to obtain other effects, such as reduced wet soiling, by varying the monomers and the ratios of the quantities thereof in the copolymer.

However, the prior art has hitherto not disclosed a method of simultaneously obtaining a pleasant, soft, velvety feel and improved hydrophily of the coated fibrous materials, particularly of cotton towelling fabrics, on this basis.

The object of this invention was therefore to discover means to remedy this shortcoming in the prior art.

According to the invention it is now possible to prepare aqueous dispersions which simultaneously produce a softening and hydrophilic finish for fibrous materials At least one quaternary compound with at least one long-chain alkyl residue is used as compounds (1). These compounds are generally known and have at least one saturated and/or unsaturated alkyl residue with at least 12, particularly 16 to 22, C atoms as the long-chain alkyl residue.

Octadecyloxymethyl-pyridinium chloride and stearylamidomethyl-pyridinium chloride are cited as examples. However, quaternary imidazolinium derivatives and quaternary ammonium derivatives are particularly suitable as compounds (1). The following are given as examples of the particularly suitable compounds:

1-ethyl stearamide-2-stearyl-3-methyl-imidazolinium-methosulphate (compound 1a);
1-methyl-2-stearic acid amido-ethylimidazolinium methosulphate (Compound 1b),
1-hydroxyethyl-2-heptadecenyl-imidazolinium-ethosulphate (Compound 1c),
dimethyl-distearyl-ammonium chloride (Compound 1d) and
dioleic acid isopropyl ester-dimethyl-ammonium-ethosulphate (Compound 1e).

The quantities of compounds (1) used range from 20 to 70 g, particularly 30 to 60 g to 1000 g aqueous dispersion.

The known polymers or copolymers on the basis of alkylacrylates with alkyl residues having at least 4 C atoms are used as compounds (2). The alkyl residues in said compounds (2) preferably have 4 to 10, particularly 4 to 8 C atoms. The following are given as examples of such base monomers, which are contained in the whole polymer in quantities of 60 to 100% weight, relative to the whole polymer:

2-ethylhexyl acrylate,
decylacrylate and in particular
butylacrylate.

Butylacrylate homopolymers are particularly well suited as compounds (2), whereas ethyl acrylate cannot be used as a base monomer. As well as the alkylacrylate homopolymers, copolymers based on the corresponding monomers can also be used as compounds (2).

The following are given as co-monomers without claim to completeness (relating in each case to the total of the monomers):

2-hydroxyethyl- or 3-hydroxypropyl-(meth)acrylate (2 to 10% weight), alkyl methacrylates with at least 4 C atoms in the alkyl residue (2 to 20% weight), ethyl acrylate (1 to 40% weight), (meth)acrylic acid (1 to 5 % weight), amides or N-methylolamides or methylolamides etherified with alcohols having 1 to 4 C atoms of $\alpha$, $\beta$-unsaturated carboxylic acids or mixtures of such monomers (0.5 to 5% weight), vinyl acetate (2 to 40% weight) and acrylonitrile (1 to 10% weight).

Said compounds (2) are available commercially in the form of 30 to 70% aqueous dispersions, whereby 20 to 80 g, particularly 20 to 60 g of compounds (2), calculated as 100% polymer, are used to produce the aqueous dispersions according to the invention.

From one case to the next, particularly if relatively small quantities of compounds (1) are used or if higher requirements are set for compatibility with optical whiteners, it is necessary to use an additional emulsifier as well as the compounds (1) when producing the aqueous dispersions. The known non-ionogenic emulsifiers (3) and/or cationic emulsifiers (3) which differ from (1) are used as emulsifiers.

A person skilled in the art knows the ethoxylated fatty alcohols, fatty amides, fatty acids, alkylphenols and fatty amines and their salts or the e.g. quaternary ammonium compounds used, and will have no difficulty in selecting said compounds accordingly. The quantities of emulsifier (3) may be up to 100% weight relative to compound (2).

A particularly pleasant and soft feel of the treated fibrous materials, and in particular noticeably increased hydrophily will be obtained if the aqueous dispersion contains in addition at least one silicone which has a hydrophilic finishing effect, in quantities of 5 to 70 g, particularly 15 to 55 g to 1000 g aqueous dispersion. Said additionally used compounds (4) are also known to a person skilled in the art. Generally, these are dimethyl polysiloxanes, which contain incorporated therein epoxy groups (a) and/or polyethoxy- or polypropoxy- or polyethoxy/propoxy groups (b).

Particularly suitable are those silicones which have groups (a) and (b) in the same molecule. A typical representative of the compounds (4) is UCARSILR ® EPS (Union Carbide Corp.). A person skilled in the art will have no difficulty in discovering similar usable compounds.

It is decisive for the effectiveness of the aqueous dispersions according to the invention that the production of the compounds (2) should take place in the presence of compounds (1) and optionally compounds (4). The object of the invention is therefore also a process for producing the aqueous dispersions according to the invention. The production of such dispersions is known in principle. Generally, an emulsion of monomers is prepared which, as well as the alkylacrylates with alkyl residues having at least 4 C atoms and optionally additional co-monomers and possibly the emulsifier (3), contains the quaternary compound having at least one long-chain alkyl residue and preferably also the compound (4). The polymerisation proper is now performed in a known way. Of course, additional known textile auxiliaries, particularly softeners and/or feel-imparting substances may be added in small quantities to the monomer emulsion and/or the finished aqueous suspension in order to round off the properties of the aqueous dispersion.

The resulting aqueous dispersions serve for providing fibrous materials of all sorts, particularly towelling fabrics, especially cotton towelling fabrics, but also bed linen, with a softening and hydrophilic finish.

For this purpose, the textiles are treated in a known way with liquors which contain 15 to 80 g/l, particularly 20 to 60 g/l, of the aqueous dispersion, relative to a dispersion with a solid content of about 20% weight, which results in a layer of about 0.3 to 3% solid substance on the fibre material. The hydrophily can be increased still further by a short period of subsequent condensation.

It is surprising that it is possible to obtain a soft, velvety feel and at the same time good to outstanding hydrophily of the coated materials in this simple way, since such a combined effect cannot be obtained by simply mixing the compounds (1) and (2) (see also following examples).

The invention will be described in greater detail by the following examples, "parts" being parts by weight and "%" being percentage weight.

EXAMPLE 1

(A) An initial emulsion was produced from 37.5 parts 1-methyl-2-stearic acid amido-ethyl-imidazoline methosulphate and 20 parts of the acetate of an ethoxylated C-16-fatty amine (in total 10 EO groups per mol) as an additional emulsifier by combining and melting down at 80° to 90° C., subsequently adding 550 parts of 90° C. hot water, cooling to 40° C. and further addition of 2.5 parts phosphoric acid (pH 5 to 6), 60 parts butylacrylate and 45 parts UCARSILR® EPS while stirring.

For polymerisation, 100 parts water and 3 parts of the above emulsifier were combined, adjusted to a pH value of 4 with 0.2 parts phosphoric acid, and 100 parts of the initial emulsion prepared as described above were added. The mixture was then heated to 60° C. and injected with 3 parts sodium persulphate solution (25%) and 2 parts Rongalit C solution (10%). The polymerisation took place at 65° to 70° C. for one hour, with the remaining monomer mixture being supplied, at the same time 3 parts of the sodium persulphate solution and 8 parts of the ® Rongalit C solution (BASF) being continuously added. Thereafter, another 2 parts sodium persulphate solution and 2 parts Rongalit C solution were added and the mixture was stirred further for 1 hour at 65° to 70° C.

Subsequently, the residual monomer content was reduced to below 0.2% by adding a mixture of 0.5 g tert.butylhydroperoxide and 0.5 g of the above emulsifier (50% in water).

At 50° C. the pH value was subsequently set at 6 to 7 using 6 parts triethanolamine and finally the product was filtered in a known manner. A good cold-resistant, stable aqueous dispersion was obtained.

(B) In order to produce the aqueous dispersion B, work was carried out as above, but with polymerisation being carried out in the absence of UCARSILR® EPS.

(C) As dispersion (B), but 45 parts UCARSILR® EPS being stirred in cold at the end.

(D) For comparison, the operating method described under (A) was carried out in the same way in the absence of the compound (1b) and the UCARSIL® EPS. Instead, after polyermisation was completed, 37.5 parts of compound (1b) were stirred in cold.

A heavy cotton towelling fabric (450 g/m$^2$) was finished with 40 g/l of the aqueous dispersions (A) to (D) produced as described above by immersing in the liquor, squeezing out to 110% liquor pickup and drying for 15 minutes at 120° C. (solid deposit approx. 1%).

The finished material had the following effects:

| Aqueous dispersion | | Feel | Hydrophily |
|---|---|---|---|
| A | according | ++(+) | +++ |
| B | to the | +++ | + |
| C | invention | + | +++ |
| D | comparison | +(−) | − |

Key
Feel
+++ very soft, velvety feel
++ soft, velvety feel
+ soft feel
+− moderately soft feel
− no soft feel effect
Hydrophily
+++ excellent hydrophilic properties
++ very good hydrophilic properties
+ good hydrophilic properties
+− moderately good hydrophilic properties
− not hydrophilic (hydrophobic)

The above results make it clear that a soft, pleasant feel and good to very good hydrophily may only be obtained simultaneously by the aqueous dispersions according to the invention.

EXAMPLE 2

Example 1 was repeated in the same manner, but with compound (1d) being used as the quaternary compound having at least one long-chain alkyl residue. The cotton towelling finished with the aqueous liquors produced according to Example 1 had the following effects:

| Aqueous dispersion | | Feel | Hydrophily |
|---|---|---|---|
| A | according | ++ | ++ |
| B | to the | ++ | + |
| C | invention | + | ++ |
| D | comparison | +(−) | − |

EXAMPLE 3

In this Example, instead of the compound (1b) used in Example 1, an aqueous dispersion was produced according to (B) using the compound (1e), whereby in addition, right at the beginning 50 parts glycerine monoisostearate were melted down as well and for this the quantity of hot water was increased to 740 parts. The cotton towelling fabric which was finished with said dispersion (B) also had a soft, velvety feel and good to very good hydrophily.

EXAMPLE 4

In the same way as described in Example 1, a monomer emulsion was prepared using 40 g of an emulsifier mixture of

| | |
|---|---|
| 250 parts | polyglycol resolate (on average 12 ethylene oxide units), |
| 200 parts | stearylaminoethoxylate (on average 8 ethylene oxide units) and |
| 6 parts | glacial acetic acid using a mixture of |
| 40 parts | butylacrylate |
| 10 parts | 2-ethylhexyl acrylate and |
| 10 parts | vinyl acetate |

and the aqueous dispersion which is compatible with optical whiteners was then produced as described in Example 1 under (A).

A lightweight cotton towelling fabric (240 g/m$^2$) was finished using 35 g/l of said aqueous dispersion by immersing in the liquor, squeezing out to 100% liquor pickup and drying for 10 minutes at 120° C. The fabric thus treated had a very soft, velvety feel and was also characterised by particularly good hydrophily.

EXAMPLE 5

In the same way as in Example 4, a monomer emulsion was produced using the monomer mixture given below, and then the aqueous dispersion was prepared as described:

| | |
|---|---|
| 40 parts | butylacrylate, |
| 5 parts | n-decylacrylate, |
| 8 parts | acrylonitrile and |
| 2 parts | N-methylolacrylamide. |

If the towelling fabric described in Example 4 is finished in the same way using 50 g/l of said dispersion, similarly good effects will be achieved.

EXAMPLE 6

Example 3 was repeated, but working in the absence of the acetate of an ethoxylated C-16-fatty amine (on average 10 ethylene oxide groups) which was used therein.

The aqueous dispersion produced thereby filters rather more poorly, but may also be used very well to finish various towelling fabrics.

We claim:

1. An aqueous polyalkylacrylate dispersion for simultaneously providing fibrous material with a softening and hydrophilic finish, comprising (1) a quaternary imidazolinium or ammonium emulsifier which is substituted with at least one alkyl or alkenyl group having at least 12 carbon atoms;

(2) an alkylacrylate polymer or copolymer in which alkylacrylate the alkyl group has at least 4 carbon atoms;

(3) optionally one or more additional emulsifiers; and (4) optionally a silicone hydrophilic finishing agent;

wherein the polymer or copolymer (2) has been polymerized in the presence of emulsifier (1).

2. A dispersion of claim 1, wherein the imidazolinium or ammonium emulsifier (1) is substituted with at least one alkyl or alkenyl group having 16 or 22 carbon atoms.

3. A dispersion of claim 1, comprising a dimethylsiloxane silicone hydrophilic finishing agent.

4. A dispersion of claim 3, comprising a modified dimethylpolysiolxane.

5. A dispersion of claim 4, comprising a dimethylpolysiloxane having epoxy groups and/or polyethoxy or polypropoxy and/or polyethoxy/propoxy groups.

6. A dispersion of claim 1, comprising 20 to 70 g of emulsifier (1), 20 to 80 g of alkylacrylate polymer or copolymer (2), and optionally 20 to 80 g of one or more emulsifiers (3), and optionally 5 to 70 g of a silicone hydrophilic finishing agent per 1000 g of aqueous dispersion.

7. A dispersion of claim 1, in which the alkylacrylate polymer or copolymer is based on alkylacrylates, the alkyl residues of the alkylacrylates having 4 to 10 carbon atoms.

8. A dispersion of claim 1, wherein the copolymer (2) consists of at lest 60% of alkylacrylate.

9. A dispersion of claim 1, wherein the copolymer alkylacrylate is containing besides the alkylacrylate 0,5 to 40% by weight, relative to the total of the polymerizable monomers, of vinyl acetate acrylonitrile, N-methylolacrylamide or N-methylolacrylamide etherified with alcohols having 1 to 4 carbon atoms in polymerized form.

10. A process for producing an aqueous polyacrylate dispersion for simultaneously providing fibrous material with a softening and hydrophilic finish, comprising (1) a quaternary imidazolinium or ammonium emulsifier which is substituted with at least one alkyl or alkenyl group having at least 12 carbon atoms, (2) an alkylacrylate polymer or copolymer in which alkylacrylate the alkyl group has at least 4 carbon atoms;

(3) optionally one or more additional emulsifiers; and (4) optionally a silicone hydrophilic finishing agent;

characterized in that said alkylacrylate is polymerized or copolymerized in an aqueous dispersion in the presence of a quaternary imidazolinium or ammonium emulsifier (1), and optionally in the presence of one or more additional emulsifiers (3) and/or a silicone hydropholic finishing agent (4).

11. A process according to claim 10, characterized in that the imidazolinium or ammonium emulsifier (1) is substituted with at least one alkyl or alkenyl residue having 16 to 22 carbon atoms.

12. A process according to claim 10, characterized in that the alkyl group of said alkylacrylate has 4 to 10 carbon atoms.

13. A process according to claim 10, characterized in that 20 to 70 g of said alkylacrylate are polymerized in the presence of 20 to 70 g of emulsifier (1) and optionally 20 to 80 g of one ore more emulsifiers (3), and optionally 5 to 70 g of a silicone hydrophilic finishing agent per 1000 g of aqueous dispersion.

14. A process according to claim 10 for the preparation of an aqueous dispersion of a copolymer (2) characterized in that vinyl acetate, acrylonitrile, N-methylolacrylamide or N-methylolacrylamide etherified with alcohols having 1 to 4 carbon atoms are used as comonomers in an amount of 0.5 to 40% by weight relative to the total of the polymerizable monomers used.

15. A method of providing fibrous material with a softening and hydrophilic finish, which method comprises treating the fibrous material with an aqueous dispersion comprising (1) a quaternary imidazolinium or ammonium emulsifier which is substituted with at least one alkyl or alkenyl group having at least 12 carbon atoms;

(2) an alkylacrylate polymer or copolymer in which alkylacrylate the alkyl group has at least 4 carbon atoms;

(3) optionally one or more additional emulsifiers; and (4) optionally a silicone hydrophilic finishing agent.

* * * * *